US010757971B2

(12) United States Patent
Liu et al.

(10) Patent No.: US 10,757,971 B2
(45) Date of Patent: Sep. 1, 2020

(54) ATOMIZER OF ELECTRONIC CIGARETTE WITH ULTRASONIC ATOMIZATION PIECE

(71) Applicant: CHINA TOBACCO HUNAN INDUSTRIAL CO., LTD., Changsha, Hunan (CN)

(72) Inventors: Jianfu Liu, Hunan (CN); Kejun Zhong, Hunan (CN); Xiaoyi Guo, Hunan (CN); Wei Huang, Hunan (CN); Yuangang Dai, Hunan (CN); Xinqiang Yin, Hunan (CN); Jianhua Yi, Hunan (CN); Hong Yu, Hunan (CN); Youlin He, Hunan (CN)

(73) Assignee: Shenzhen Xiangyan Technology Co., Ltd., Shenzhen (CN)

( * ) Notice: Subject to any disclaimer, the term of this patent is extended or adjusted under 35 U.S.C. 154(b) by 221 days.

(21) Appl. No.: 15/577,578

(22) PCT Filed: Jun. 22, 2016

(86) PCT No.: PCT/CN2016/086650

§ 371 (c)(1),
(2) Date: Nov. 28, 2017

(87) PCT Pub. No.: WO2017/206211

PCT Pub. Date: Dec. 7, 2017

(65) Prior Publication Data

US 2018/0352854 A1 Dec. 13, 2018

(30) Foreign Application Priority Data

May 31, 2016 (CN) ..... 2016 1 0374950

(51) Int. Cl.
*A24F 13/00* (2006.01)
*A24F 17/00* (2006.01)
(Continued)

(52) U.S. Cl.
CPC ..... *A24F 47/002* (2013.01); *A24F 47/008* (2013.01); *B05B 17/0607* (2013.01)

(58) Field of Classification Search
CPC ..... A24F 47/008; A24F 47/002
(Continued)

(56) References Cited

U.S. PATENT DOCUMENTS

2006/0196518 A1* 9/2006 Hon ..... A24F 47/008 131/360
2007/0267031 A1* 11/2007 Hon ..... A24B 15/16 131/273
(Continued)

FOREIGN PATENT DOCUMENTS

CN 204070580 U 1/2015
CN 204104843 U 1/2015
(Continued)

OTHER PUBLICATIONS

International Search Report issued in International Application No. PCT/CN2016/086650 dated Feb. 17, 2017, 4 pages.

*Primary Examiner* — Abdullah A Riyami
*Assistant Examiner* — Thang H Nguyen
(74) *Attorney, Agent, or Firm* — Mauriel Kapouytian Woods LLP; Liang Huang; Michael Mauriel

(57) ABSTRACT

Embodiments of the present invention disclose an atomizer of electronic cigarette, comprising an ultrasonic atomization piece, wherein one surface of the ultrasonic atomization piece is in contact with a tobacco tar storage piece; the tobacco tar storage piece communicates with a tobacco tar cavity; the tobacco tar storage piece communicates with an airflow passage; and the tobacco tar storage piece and the ultrasonic atomization piece are sequentially provided along a smoke outflow direction.

23 Claims, 10 Drawing Sheets

(51) Int. Cl.
*A24F 25/00* (2006.01)
*A24F 47/00* (2020.01)
*B05B 17/06* (2006.01)

(58) Field of Classification Search
USPC ..... 131/329, 328
See application file for complete search history.

(56) References Cited

U.S. PATENT DOCUMENTS

| | | | | |
|---|---|---|---|---|
| 2011/0036346 | A1* | 2/2011 | Cohen | A24F 47/008 128/200.14 |
| 2016/0106143 | A1* | 4/2016 | Mei | A24B 15/14 131/374 |
| 2018/0161525 | A1* | 6/2018 | Liu | A24F 40/40 |

FOREIGN PATENT DOCUMENTS

| | | | |
|---|---|---|---|
| CN | 204519367 | U | 8/2015 |
| CN | 104983078 | A | 10/2015 |
| CN | 105192894 | A | 12/2015 |
| CN | 105266206 | A | 1/2016 |
| CN | 105559150 | A | 5/2016 |
| CN | 105559151 | A | 5/2016 |
| JP | 2001069963 | A | 3/2001 |

* cited by examiner

ATOMIZER OF ELECTRONIC CIGARETTE WITH ULTRASONIC ATOMIZATION PIECE

CROSS REFERENCE TO RELATED APPLICATIONS

This application is a national phase application of international application number PCT/CN2016/086650 filed on Jun. 22, 2016, which claims priority to Chinese application number 201610374950X filed on May 31, 2016. The entire contents of these applications are hereby incorporated herein by reference.

TECHNICAL FIELD

The present invention relates to an atomizer of electronic cigarette.

BACKGROUND ART

The existing atomizer of electronic cigarettes generally adopt heating wires to heat tobacco tar in tobacco tar storage cotton. The temperatures of the heating wires are relatively high in a heating process, so the heating wires are easily to be scorched and produce burnt flavor. Moreover, high temperature of the heating wires can be easily transferred to outer walls of the atomizers, so that the electronic cigarette becomes hot, the energy efficiency is low, the smoking taste is poor, and meanwhile the atomizers are prone to tobacco tar leakage. Smoke molecules produced by atomization of the existing ultrasonic atomizers contain molecules with larger particle sizes, resulting in poor smoking taste.

CONTENTS OF INVENTION

The technical problem to be solved in the present invention is to provide an atomizer of electronic cigarette in view of the shortcomings of the prior art.

To solve the above-mentioned technical problem, the present invention adopts the technical solutions as follows: an atomizer of electronic cigarette, comprising an ultrasonic atomization piece; one surface of the ultrasonic atomization piece is in contact with a tobacco tar storage piece; the tobacco tar storage piece communicates with a tobacco tar cavity; the tobacco tar storage piece communicates with an airflow passage, so that the airflow passage can take away the smoke produced by the ultrasonic atomization piece by atomizing the tobacco tar on the tobacco tar storage piece; and the tobacco tar storage piece and the ultrasonic atomization piece are sequentially provided along a smoke outflow direction.

The ultrasonic atomization piece and the tobacco tar storage piece are fixed in an elastic fixing base; one surface of the tobacco tar storage piece which is away from the ultrasonic atomization piece is in contact with a tobacco tar guide body fixed in the elastic fixing base; and the tobacco tar guide body communicates with the tobacco tar cavity. The elastic fixing base can well stabilize the ultrasonic atomization piece and the tobacco tar storage piece, and can provide a buffer force in the case of oscillation of the ultrasonic atomization piece to protect the ultrasonic atomization piece.

One surface of the ultrasonic atomization piece which is away from the tobacco tar storage piece is in contact with an elastic pressure cover; the elastic pressure cover is fixed in a connecting sleeve; and the connecting sleeve is connected with the elastic fixing base. The elastic pressure cover can guarantee the clinging between the ultrasonic atomization piece and the tobacco tar storage piece so as to prevent idle vibration of the ultrasonic atomization piece.

A first through hole is provided in the elastic pressure cover; a mounting base is fixed in the first through hole; a first electric conductor is installed on the mounting base; a second electric conductor is provided between the tobacco tar storage piece and the elastic fixing base; and both of the first electric conductor and the second electric conductor are in contact with the ultrasonic atomization piece.

The second electric conductor comprises a recessed part with an inverted U-shaped cross section, the structures of both sides of the recessed part are symmetrical, a left side cross section of the recessed part comprises a vertical part and a horizontal part connected with the vertical part, and the horizontal part is connected with the left side of the recessed part; the recessed part is provided in a mounting hole in the middle of the elastic fixing base; both sides of the recessed part are provided in grooves on both sides of the mounting hole in the elastic fixing base, and the vertical part of the second electric conductor is provided with a vent hole; the ultrasonic atomization piece and the tobacco tar storage piece are fixed in the second electric conductor; and an edge of the ultrasonic atomization piece is in contact with the inner wall of the vertical part. Thus, good electric contact between the second electric conductor and the ultrasonic atomization piece can be realized, and the clinging between the ultrasonic atomization piece and the tobacco tar storage piece can also be realized to guarantee normal supply of tobacco tar during atomization.

The tobacco tar guide body comprises an annular bottom and two projections provided on the annular bottom, and the two projections respectively stretch into two fixing holes in the elastic fixing base on the side face of the mounting hole. The structure can be more compact and stable.

The side wall on the top end of the tobacco tar cavity is in fixed connection with an upper fixing sleeve; the side wall on the bottom end of the tobacco tar cavity is in fixed connection with a lower fixing sleeve; tobacco tar block rings are provided between the side wall on the top end of the tobacco tar cavity and between the upper fixing sleeve, and between the side wall on the bottom end of the tobacco tar cavity and the lower fixing sleeve, respectively; the top end of the upper fixing sleeve is in fixed connection with a suction nozzle base; and a suction nozzle is installed on the suction nozzle base. The tobacco tar block rings can prevent the leakage of tobacco tar so as to guarantee against tobacco tar leakage of the atomizer.

The bottom end of the lower fixing sleeve is provided in a threaded sleeve with an open upper end; an electrode ring mounting hole is provided in the bottom surface of the threaded sleeve; and an electrode ring stretches into the electrode ring mounting hole and is in insulation connection with the side wall of the electrode ring mounting hole.

In a preferred technical solution of the present invention, the tobacco tar cavity is provided below the tobacco tar guide body.

A supporting tube provided along the axial direction of the tobacco tar cavity is fixed in the tobacco tar cavity; tobacco tar guide cotton is provided outside the supporting tube; and the top end of the tobacco tar guide cotton is in contact with the tobacco tar guide body. Sufficient supply of the tobacco tar can be guaranteed.

An outer tube is provided outside the tobacco tar guide cotton, and a tobacco tar inlet hole is provided in the outer tube. The outer tube can prevent the tobacco tar guide cotton from dropping of, thereby the stability of the tobacco tar guide cotton can be further guaranteed.

A first convex ring and a second convex ring are provided respectively on the outer wall of the top end and on the outer wall of the bottom end of the supporting tube; the tobacco tar storage cotton and the outer tube are provided between the first convex ring and the second convex ring, the top end of the supporting tube stretches into a second through hole in the annular bottom of the tobacco tar guide body, and the lower surface of the first convex ring is in contact with the upper surface of the annular bottom of the tobacco tar guide body; and the second convex ring is provided on a third through hole in the lower fixing sleeve. Due to the arrangement of the first convex ring and the second convex ring, the problem of fixing the supporting tube and the outer tube can be smartly solved, and thus the structure is exquisite.

The top end of the electrode ring is in contact with the bottom end of an electrode column; and the top end of the electrode column is in contact with the second electric conductor after penetrating through the supporting tube. Good electric contact in the atomizer can be guaranteed.

The suction nozzle base comprises a connecting base at the bottom, and a cylinder with an open top end is fixed to the end face of the connecting base; the cylinder is in fixed connection with the suction nozzle; a connecting hole is provided in the connecting base in the cylinder; the elastic fixing base and the connecting sleeve are both provided in the connecting base, and the top end of the connecting sleeve is in fixed connection with the inner wall of the connecting hole; a vent ring is provided in the connecting base between the cylinder and the connecting hole; a gap is provided among the connecting sleeve, the elastic fixing base and the inner wall of the connecting base, and the gap communicates with the vent ring. A gap is provided between the electrode column and the inner wall of the supporting tube; a first air inlet hole communicated with the gap is provided in the threaded sleeve; both of the interior of the top end and the interior of the bottom end of the electrode column are hollow cavities, and second air inlet holes communicated with the gap are provided in the side walls of the hollow cavities; both of the top end and the bottom end of the electrode column are open, and a third air inlet hole is provided in the bottom end of the electrode column; and the first air inlet hole, the third air inlet hole, the hollow cavity in the interior of the bottom end of the electrode column, the second air inlet hole in the hollow cavity of the bottom end of the electrode column, the gap, the second air inlet hole in the hollow cavity of the top end of the electrode column, the hollow cavity in the interior of the top end of the electrode column, the vent hole, the vent ring and the inner cavity of the suction nozzle form the airflow passage. The airflow flows into from the lower side of the tobacco tar storage piece. Under the acting force of the airflow, the ejection acting force of large-particle smoke is overcame, so that the large-particle of smoke is taken back to the tobacco tar storage piece by the airflow to be atomized again, instead of being inhaled by a user.

The elastic fixing base is provided in the upper fixing sleeve, and the annular bottom of the tobacco tar guide body is in contact with the end face of the upper fixing sleeve; a tobacco tar pass hole is provided in the end face of the upper fixing sleeve; and the annular bottom of the tobacco tar guide body communicates with the tobacco tar cavity through the tobacco tar pass hole. An auxiliary tobacco tar supply passage formed by the tobacco tar pass hole, the tobacco tar guide body and the tobacco tar storage piece can provide the tobacco tar quickly when the atomizer is started.

In another embodiment of the present invention, the tobacco tar cavity is provided above the ultrasonic atomization piece.

The recessed part of the second electric conductor is in contact with the electrode ring, and a hole is provided in the recessed part; an air passage penetrating through the electrode ring is formed in the electrode ring; and the air passage communicates with the hole.

In the optimized technical solution, the atomizer further comprises an atomization head connecting base and an atomization head upper cover; the upper end of the atomization head connecting base is in fixed connection with the atomization head upper cover; the elastic fixing base and the connecting sleeve are both fixed in a hollow cavity formed by the atomization head connecting base and the atomization head upper cover; the upper end of the atomization head upper cover is fixed in the lower fixing sleeve; passages are provided between the atomization head upper cover and the lower fixing sleeve and between the atomization head connecting base and the threaded sleeve, and the passages communicate with the tobacco tar cavity through tobacco tar outlet holes in the lower fixing sleeve.

The tobacco tar guide body is in contact with the inner wall of the lower end of the atomization head connecting base, and a tobacco tar inlet communicated with the passages is provided in the side wall of the lower end of the atomization head connecting base. The tobacco tar enters from the tobacco tar inlet to be supplied to the tobacco tar guide body.

An air tube is fixed in the tobacco tar cavity; a notch is provided in the upper end of the atomization head connecting base; a vent passage is provided between the connecting sleeve and the atomization head upper cover, and the notch communicates with the vent passage; a vent hole is provided in the upper end face of the atomization head upper cover; and the air passage, the hole, the gap between the horizontal part of the second electric conductor and the ultrasonic atomization piece, the notch, the vent passage, the vent hole, the inner cavity of the air tube and the inner cavity of the suction nozzle form the airflow passage.

An air regulating hole communicated with the airflow passage is provided in the suction nozzle base; and a regulating device for regulating the amount of the air inflow of the air regulating hole is provided on the suction nozzle base outside the air regulating hole. Thus, the user can conveniently adjust the amount of air inflow as needed.

An air pass hole or an air pass groove is formed in the tobacco tar storage piece, so that the airflow can quickly take away the smoke atomized by the ultrasonic atomization piece through the air pass hole or the air pass groove, thereby speeding up the starting of the ultrasonic atomization piece and enhancing user experiences.

Compared with the prior art, the present invention has the following beneficial effects: the present invention generates smoke by the oscillation of the ultrasonic atomization piece, thereby solving the problems that a heating wire is scorched easily during heating to produce burnt flavor, moreover the high temperature produced by the heating wire is transferred to the outer wall of the atomizer easily, so that the electronic cigarette becomes hot, the energy efficiency is low, the smoking taste is poor, and the atomizer is prone to tobacco tar leakage. The tobacco tart storage piece is in contact with the lower surface of the ultrasonic atomization piece, the smoke is ejected from a reverse airflow direction, so that the large-particle smoke can condense on the atomization piece or on the tobacco tar storage piece to prevent the large-particle smoke from being inhaled by the user, therefore the smoking taste can be improved, and small-p article modules enter the oral cavity of the user along the airflow direction, accordingly the user experience is enhanced. The present invention is compact and exquisite in structure, strong in practicability and easy to popularize.

SPECIFIC MODE FOR CARRYING OUT THE INVENTION

A top end, an upper end or an upper surface mentioned in the present invention refers to an end face or a surface in a smoke outflow direction; and a bottom end, a lower end or a lower surface are in the opposite direction.

Figure 1:
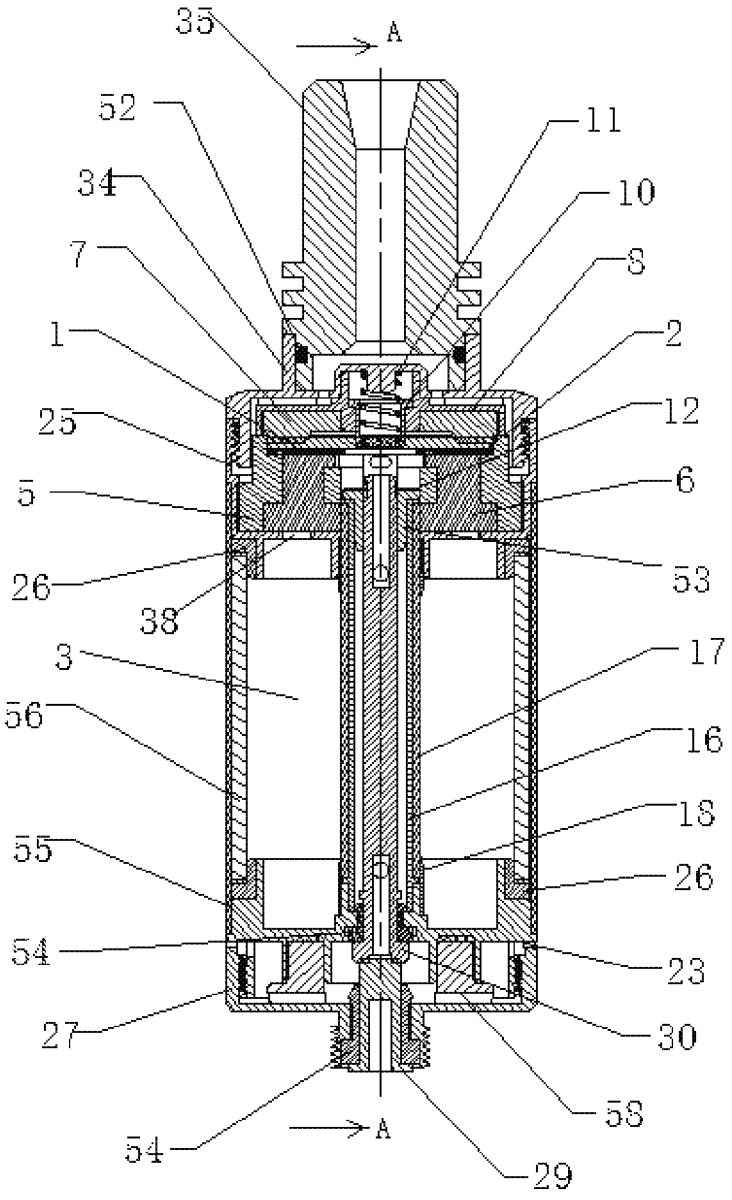
FIG. 1 is a sectional view of embodiment 1 of the present invention.
Figure 2:
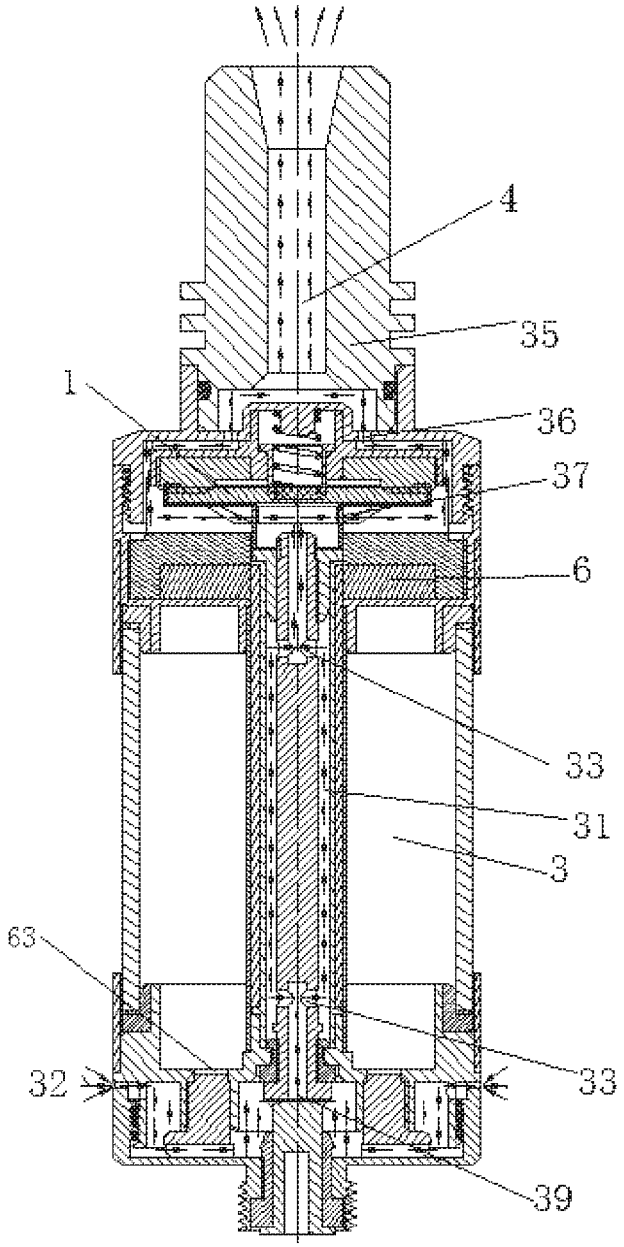
FIG. 2 is a sectional view of an A-A surface of FIG. 1.

As shown in FIG. 1 and FIG. 2, embodiment 1 of the present invention comprises an ultrasonic atomization piece 1; the lower surface of the ultrasonic atomization piece 1 is in contact with a tobacco tar storage piece 2; the tobacco tar storage piece 2 communicates with a tobacco tar cavity 3; the tobacco tar storage piece 2 communicates with an airflow passage 4; and the tobacco tar storage piece 2 and the ultrasonic atomization piece 1 are sequentially provided along the smoke outflow direction. That is, the airflow is ejected from the lower surface of the ultrasonic atomization piece to prevent large-particle smoke from being directly taken into the mouth of a user by the airflow.

In the present invention, the ultrasonic atomization piece adopts a solid piezoelectric ceramic piece.

To prevent that the clinging between the ultrasonic atomization piece and the tobacco tar storage piece is not tight and guarantee better ejection of the smoke, an air pass hole or an air pass groove can be provided in the tobacco tar storage piece.

The ultrasonic atomization piece 1 and the tobacco tar storage piece 2 are fixed in an elastic fixing base 5; one surface of the tobacco tar storage piece 2 which is away from the ultrasonic atomization piece 1 is in contact with a tobacco tar guide body 6 fixed in the elastic fixing base 5; and the tobacco tar guide body 6 communicates with the tobacco tar cavity 3.

The elastic fixing base can be a silica gel base, which can not only fix the ultrasonic atomization piece, but also provide a buffer force in an oscillation process of the ultrasonic atomization piece to protect the ultrasonic atomization piece and prevent the ultrasonic atomization piece from being damaged.

One surface of the ultrasonic atomization piece 1 which is away from the tobacco tar storage piece 2 is in contact with an elastic pressure cover 7; the elastic pressure cover 7 is fixed in a connecting sleeve 8; and the connecting sleeve 8 is connected with the elastic fixing base 5.

In the present invention, the elastic pressure cover can be a silica gel cover, and the elastic pressure cover can compress the ultrasonic atomization piece and tobacco tar guide cotton tightly in the elastic fixing base so as to guarantee the tight clinging between the ultrasonic atomization piece and the tobacco tar guide cotton.

Figure 3:
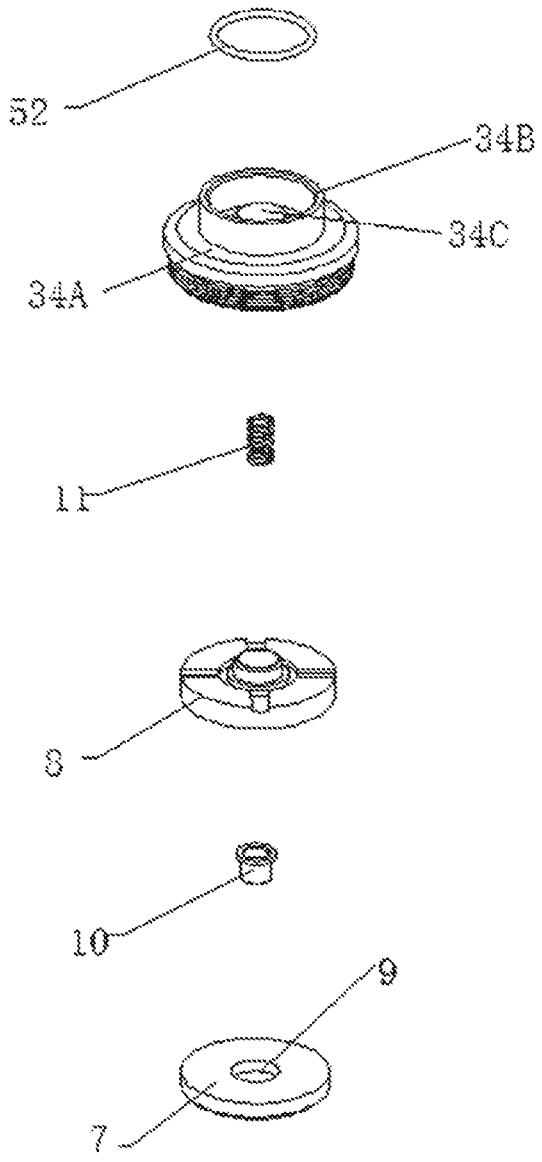
FIG. 3 is an explosive view of a structure from a suction nozzle base to an elastic pressure cover in embodiment 1 of the present invention.

As shown in FIG. 3, a first through hole 9 is provided in the elastic pressure cover 7; a mounting base 10 is fixed in the first through hole 9; a first electric conductor 11 is installed on the mounting base 10; a second electric conductor 12 is provided between the tobacco tar storage piece 2 and the elastic fixing base 5; and both of the first electric conductor 11 and the second electric conductor 12 are in contact with the ultrasonic atomization piece 1. A good electric connection can be guaranteed.

Figure 4:
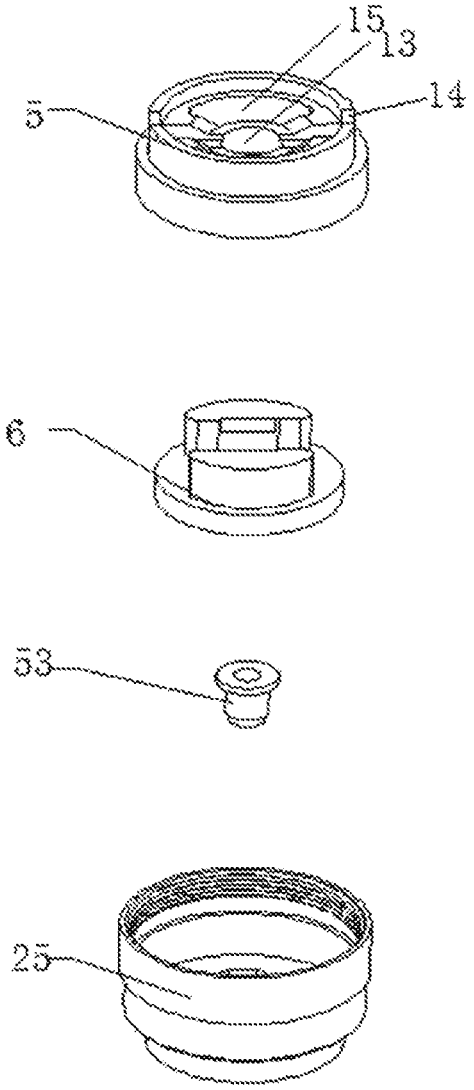
FIG. 4 is an explosive view of a structure from an elastic fixing base to an upper fixing sleeve in embodiment 1 of the present invention.
Figure 5:
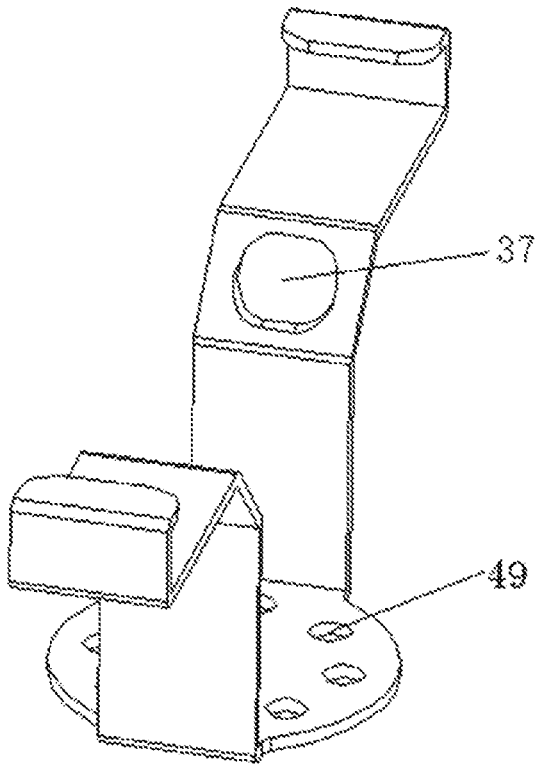
FIG. 5 is a structural schematic diagram of a second electric conductor in embodiment 1 and embodiment 2 of the present invention.

As shown in FIG. 2, FIG. 4 and FIG. 5, the second electric conductor 12 comprises a recessed part with an inverted U-shaped cross section, the structures of both sides of the recessed part are symmetrical, a left side cross section of the recessed part comprises a vertical part and a horizontal part connected with the vertical part, and the horizontal part is connected with the left side of the recessed part; the recessed part is provided in a mounting hole 13 in the middle of the elastic fixing base 5; both sides of the recessed part are provided in grooves 14 on both sides of the mounting hole 13 in the elastic fixing base 5, and the vertical part of the second electric conductor 12 is provided with a vent hole 37; the ultrasonic atomization piece 1 and the tobacco tar storage piece 2 are fixed in the second electric conductor 12; and an edge of the ultrasonic atomization piece 1 is in contact with the inner wall of the vertical part. The second electric conductor not only plays a conducting role, but also further fixes the ultrasonic atomization piece and the tobacco tar storage piece, so that the internal structure of the atomizer can be more compact.

As shown in FIG. 4, the tobacco tar guide body 6 comprises an annular bottom and two projections provided on the annular bottom, and the two projections respectively stretch into two fixing holes 15 in the elastic fixing base 5 on the side of the mounting hole 13. The top ends of the two projections are in direct contact with the tobacco tar storage piece, so that the internal structure of the atomizer can be more compact and stable.

As shown in FIG. 1, the side wall on the top end of the tobacco tar cavity 3 is in fixed connection with an upper fixing sleeve 25; the side wall on the bottom end of the tobacco tar cavity 3 is in fixed connection with a lower fixing sleeve 23; tobacco tar block rings 26 are provided between the side wall on the top end of the tobacco tar cavity 3 and the upper fixing sleeve 25 and between the side wall on the bottom end of the tobacco tar cavity 3 and the lower fixing sleeve 23; the top end of the upper fixing sleeve 25 is in fixed connection with a suction nozzle base 34; and a suction nozzle 35 is installed on the suction nozzle base 34.

To ensure the performance of sealing of the connection, the connection place of the suction nozzle base 34 and the suction nozzle 35 are in sealed connection by a sealing ring 52.

Figure 6:
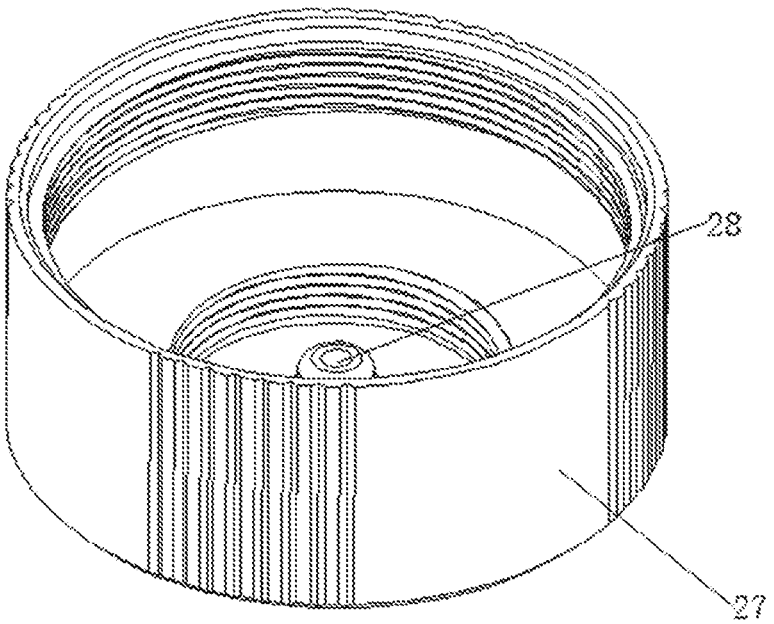
FIG. 6 is a structural schematic diagram of a threaded sleeve in embodiment 1 of the present invention.

As shown in FIG. 1 and FIG. 6, the bottom end of the lower fixing sleeve 23 is provided in a threaded sleeve 27 with an open upper end; an electrode ring mounting hole 28 is provided in the bottom surface of the threaded sleeve 27; and an electrode ring 29 stretches into the electrode ring mounting hole 28 and is in insulation connection with the side wall of the electrode ring mounting hole 28 through an insulation ring 54.

In the embodiment 1 of the present invention, the tobacco tar cavity 3 is provided below the tobacco tar guide body 6.

In the embodiment 1 of the present invention, the first electric conductor 11 is a conductive spring. One end of the conductive spring is in contact with the ultrasonic atomization piece, and the other end of the conductive spring is in contact with the inner wall of the suction nozzle base.

Figure 7:
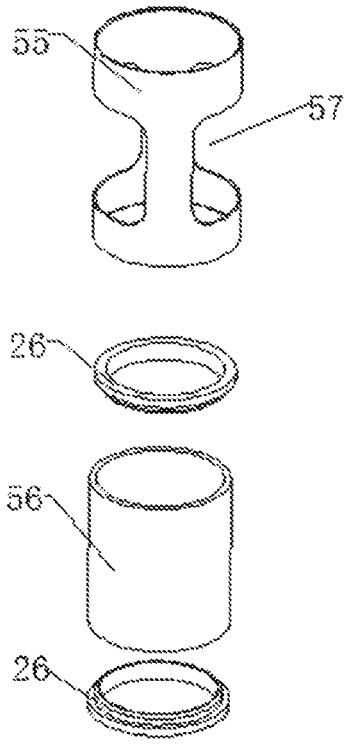
FIG. 7 is an explosive view of a structure of an atomization outer sleeve and an atomization sleeve in embodiment 1 of the present invention.

As shown in FIG. 7, in the embodiment 1 of the present invention, a hollow cavity in an atomization sleeve 56 is the tobacco tar cavity, and an observation window 57 is provided in the side wall of an atomization outer sleeve 55, and the atomization sleeve 56 is provided in the atomization outer sleeve 55. Tobacco tar storage conditions in the tobacco tar cavity can be observed by the observation window so that the tobacco tar can be added in time.

Figure 8:
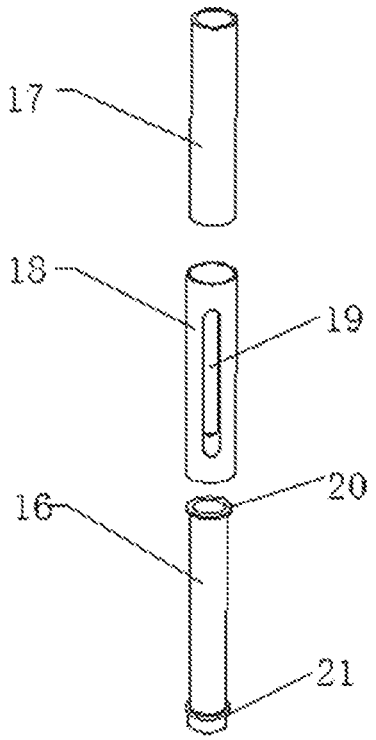
FIG. 8 is an explosive view of a structure of a supporting tube and an outer tube in embodiment 1 of the present invention.

As shown in FIG. 1 and FIG. 8, a supporting tube 16 provided along the axial direction of the tobacco tar cavity 3 is fixed in the tobacco tar cavity 3; tobacco tar guide cotton 17 is provided outside the supporting tube 16; and the top end of the tobacco tar guide cotton 17 is in contact with the tobacco tar guide body 6.

As shown in FIG. 8, an outer tube 18 is provided outside the tobacco tar guide cotton 17, and a tobacco tar inlet hole 19 is provided in the outer tube 18.

Figure 9:
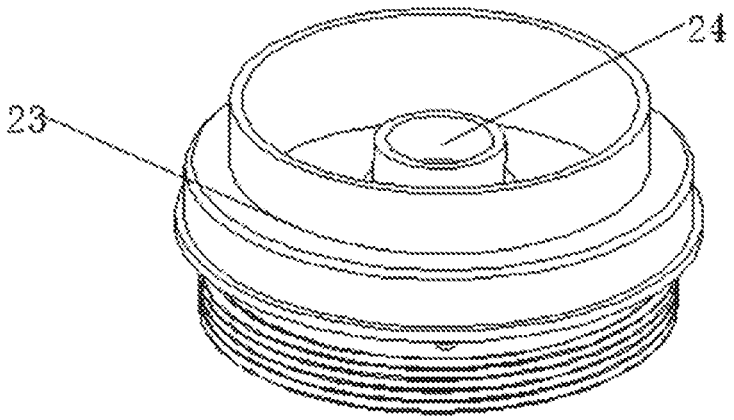
FIG. 9 is a structural schematic diagram of a lower fixing sleeve in embodiment 1 of the present invention.

A first convex ring 20 and a second convex ring 21 are provided respectively on outer walls of the top end and on the bottom end of the supporting tube 16; the tobacco tar storage cotton 17 and the outer tube 18 are provided between the first convex ring 20 and the second convex ring 21; the top end of the supporting tube 16 stretches into a second through hole 22 in the annular bottom of the tobacco tar guide body 6, and the lower surface of the first convex ring 20 is in contact with the upper surface of the annular bottom of the tobacco tar guide body 6; and the second convex ring 21 is provided on a third through hole 24 (as shown in FIG. 9) in the lower fixing sleeve 23. The first convex ring 20 and the second convex ring 21 can support the tobacco tar storage cotton 17 and the outer tube 18 and can fix the supporting tube 16.

The top end of the electrode ring 29 is in contact with the bottom end of an electrode column 30; the top end of the electrode column 30 is in contact with the second electric conductor 12 after penetrating through the supporting tube 16; and the top end of the electrode column 30 is in insulation isolation with the supporting tube 16 by an insulation plug 53.

As shown in FIG. 3, the suction nozzle base 34 of the present invention comprises a connecting base 34A at the bottom, and a cylinder 34B with an open top end is fixed to the end face of the connecting base 34A; the cylinder 34B is in fixed connection with the suction nozzle 35; a connecting hole 34C is provided in the connecting base 34A in the cylinder 34B; the elastic fixing base 5 and the connecting sleeve 8 are both provided in the connecting base 34A, and the top end of the connecting sleeve 8 is in fixed connection with the inner wall of the connecting hole 34C; a vent ring 36 is provided in the connecting base 34A between the cylinder 34B and the connecting hole 34C; a gap is provided among the connecting sleeve 8, the elastic fixing base 5 and the inner wall of the connecting base 34A, and the gap communicates with the vent ring 36.

As shown in FIG. 2, a gap 31 is provided between the electrode column 30 and the inner wall of the supporting tube 16; a first air inlet hole 32 communicated with the gap 31 is provided in the threaded sleeve 27; both of the interior of the top end and the interior of the bottom end of the electrode column 30 are hollow cavities, and second air inlet holes 33 communicated with the gap 31 are provided in the side walls of the two hollow cavities; both of the top end and the bottom end of the electrode column 30 are open, and a third air inlet hole 39 is provided in the bottom end of the electrode column 30; and the first air inlet hole 32, the third air inlet hole 39, the hollow cavity in the interior of the bottom end of the electrode column 30, the second air inlet hole 33 in the hollow cavity of the bottom end of the electrode column 30, the gap 31, the second air inlet hole 33 in the hollow cavity of the top end of the electrode column 30, the hollow cavity in the interior of the top end of the electrode column 30, the vent hole 37, the vent ring 36 and the inner cavity of the suction nozzle 35 form the airflow passage 4.

As shown in FIG. 2, in the embodiment 1 of the present invention, the elastic fixing base 5 is provided in the upper fixing sleeve 25, and the annular bottom of the tobacco tar guide body 6 is in contact with the end face of the upper fixing sleeve 25; a tobacco tar pass hole 38 is provided in the end face of the upper fixing sleeve 25; and the annular bottom of the tobacco tar guide body 6 communicates with the tobacco tar cavity 3 through the tobacco tar pass hole 38.

Bottom of the electrode column 40 is in insulation connection with the lower fixing sleeve 23 through an insulation ring 54.

In the embodiment 1, for convenient tobacco tar injection, a plug of tobacco tar injection opening 58 is provided below the lower fixing sleeve 23, a tobacco tar injection opening 63 is provided in the lower fixing sleeve 23. When the tobacco tar needs to be added, the tobacco tar injection opening 58 can be opened and then the tobacco tar can be added from the tobacco tar injection opening 63.

In the embodiment 1 of the present invention, a first tobacco tar guide path is formed by the tobacco tar guide cotton 17, the tobacco tar guide body 6 and the tobacco tar storage piece 2. A second tobacco tar guide path is formed by the tobacco tar pass hole 38, the tobacco tar guide body 6 and the tobacco tar storage piece 2. When the atomizer is started, the tobacco tar is supplied by both of the first tobacco tar guide path and the second tobacco tar guide path simultaneously to guarantee that the tobacco tar can be supplied to the tobacco tar storage piece quickly.

In embodiment 2 of the present invention, the tobacco tar cavity 3 is provided above the ultrasonic atomization piece 1.

The recessed part of the second electric conductor 12 is in contact with the electrode ring 29, and a hole 49 is provided in the recessed part; an air passage 50 penetrating through the electrode ring 29 is provided in the electrode ring 29; and the air passage 50 communicates with the hole 49.

Figure 10:
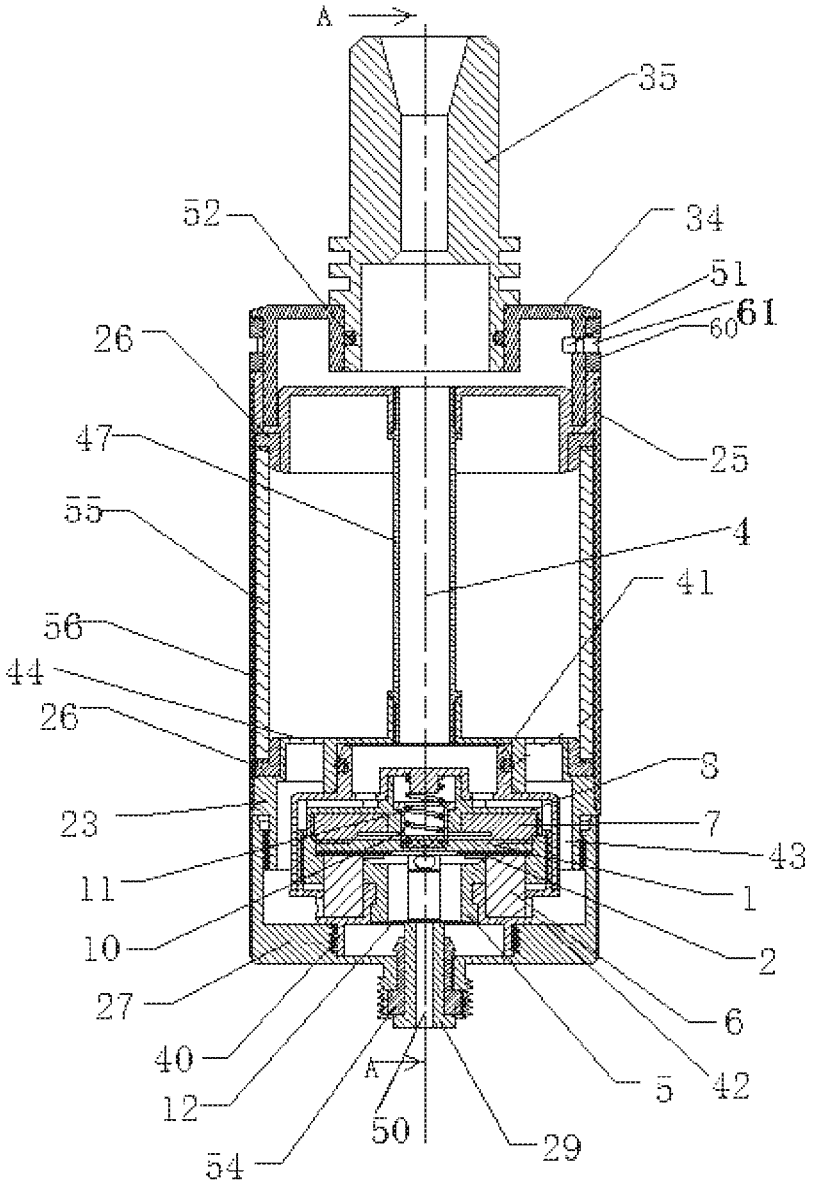
FIG. 10 is a sectional view of embodiment 2 of the present invention.
Figure 11:
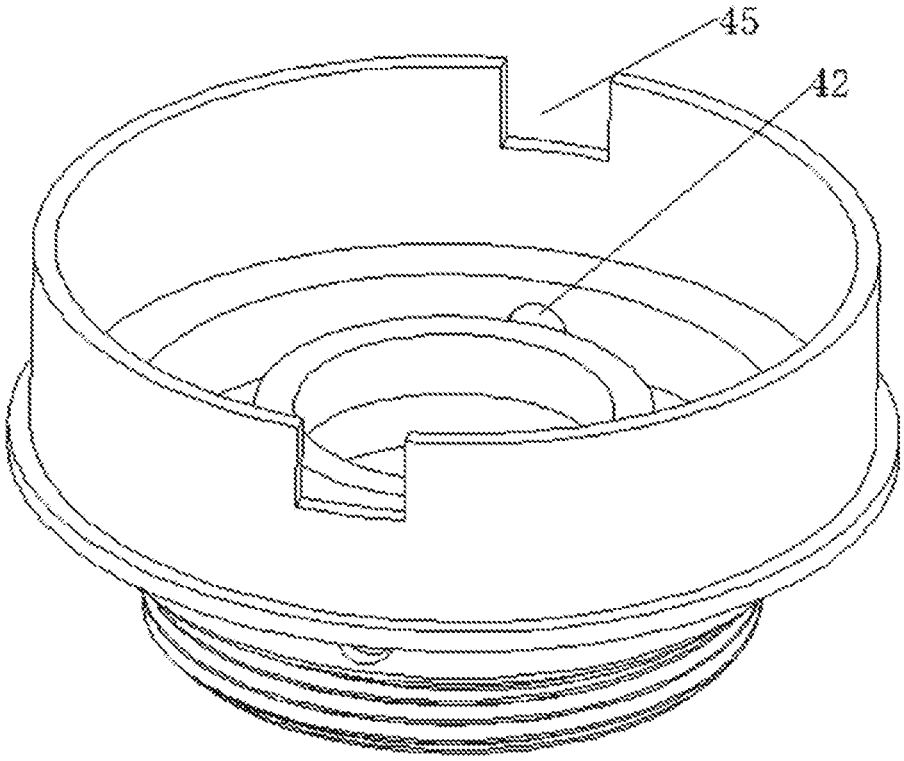
FIG. 11 is a structural schematic diagram of an atomization head connecting base in embodiment 2 of the present invention.

As shown in FIG. 10 and FIG. 11, the atomizer 2 in the embodiment 2 further comprises an atomization head connecting base 40 and an atomization head upper cover 41; the upper end of the atomization head connecting base 40 is in fixed connection with the atomization head upper cover 41; the elastic fixing base 5 and the connecting sleeve 8 are both fixed in a hollow cavity formed by the atomization head connecting base 40 and the atomization head upper cover 41; the upper end of the atomization head upper cover 41 is fixed in the lower fixing sleeve 23; passages 43 are provided between the atomization head upper cover 41 and the lower fixing sleeve 23 and between the atomization head connecting base 40 and the threaded sleeve 27, and the passages 43 communicate with the tobacco tar cavity 3 through tobacco tar outlet holes 44 in the lower fixing sleeve 23.

The tobacco tar guide body 6 is in contact with the inner wall of the lower end of the atomization head connecting base 40, and a tobacco tar inlet 42 communicated with the passages 43 is provided in the side wall of the lower end of the atomization head connecting base 40.

Figure 12:
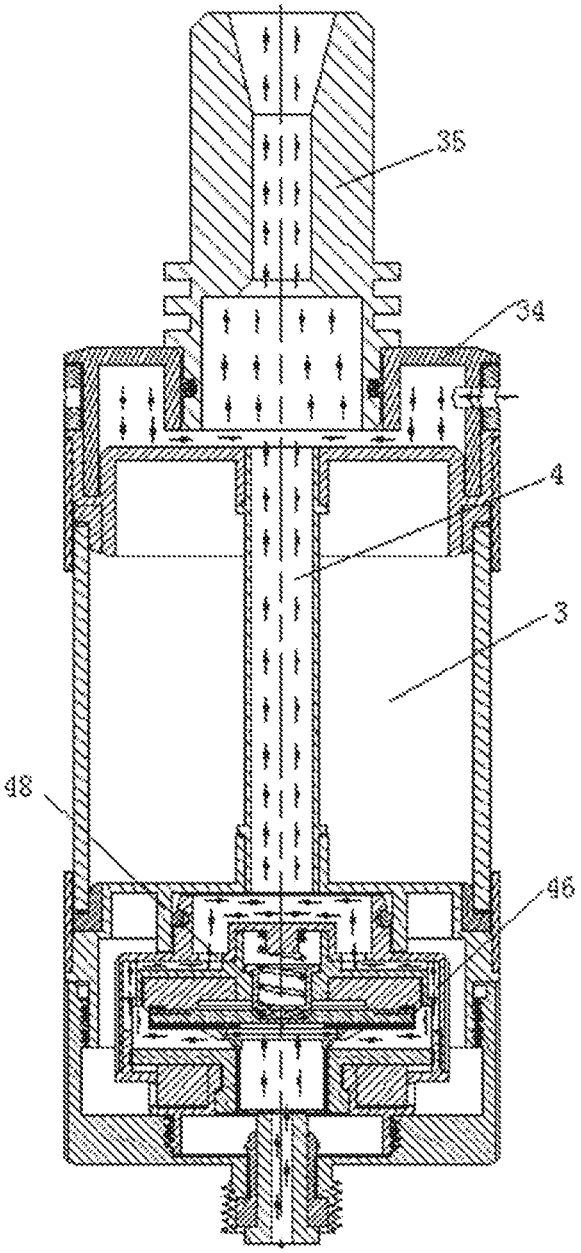
FIG. 12 is a sectional view of an A-A surface of FIG. 10.

As shown in FIG. 10 and FIG. 12, an air tube 47 is fixed in the tobacco tar cavity 3; a notch 45 is provided in the upper end of the atomization head connecting base 40; a vent passage 46 is provided between the connecting sleeve 8 and the atomization head upper cover 41, and the notch 45 communicates with the vent passage 46; a vent hole 48 is provided in the upper end face of the atomization head upper cover 41; and the air passage 50, the hole 49, the gap between the horizontal part of the second electric conductor 12 and the ultrasonic atomization piece 1, the notch 45, the vent passage 46, the vent hole 48, inner cavity of the air tube 47 and the inner cavity of the suction nozzle 35 form the airflow passage 4.

In the embodiment 2 of the present invention, the first electric conductor 11 is a conductive spring, one end of the conductive spring is in contact with the ultrasonic atomization piece, and the other end of the conductive spring is in contact with the inner wall of the atomization head upper cover.

An air regulating hole 51 communicated with the airflow passage 4 is provided in the suction nozzle base 34.

A regulating device for regulating the amount of the airflow of the air regulating hole 51 is provided on the suction nozzle base 34 outside the air regulating hole 51.

In the present invention, the regulating device comprises an air regulating ring 60 fixed to the suction nozzle base 34, an air ring hole 61 is provided in the air regulating ring 60, the air regulating ring 60 can rotate, when the position of the air ring hole 61 is coincided with that of the air regulating hole 51, the air inflow is the maximum, and otherwise, the amount of the air inflow becomes small and even the air regulating hole is closed.

In the embedment 1 and the embodiment 2 of the present invention, the airflow enters from the bottom of the atomizer and takes away the smoke from the lower part of the tobacco tar storage piece to prevent the large particle smoke from entering the oral cavity of the user, that is, the airflow moves in the reverse direction relative to the direction of the smoke ejected by the ultrasonic atomization piece by atomizing the tobacco tar, so that the airflow overcomes the gravity and the ultrasonic ejection force of large-particle smoke to move the large-particle smoke in a reverse ejection direction, accordingly the large-particle smoke is absorbed by the tobacco tar storage piece and is atomized by oscillation again so as to further prevent the large-particle smoke modules from being inhaled by the user, as a result, the smoking taste is further improved, and the user experience is enhanced.

The invention claimed is:

1. An atomizer of electronic cigarette, wherein:

the atomizer of electronic cigarette comprises an ultrasonic atomization piece;

one surface of the ultrasonic atomization piece is in contact with a tobacco tar storage piece;

the tobacco tar storage piece communicates with a tobacco tar cavity;

the tobacco tar storage piece communicates with an airflow passage;

the tobacco tar storage piece and the ultrasonic atomization piece are sequentially provided along a smoke outflow direction;

the ultrasonic atomization piece and the tobacco tar storage piece are fixed in an elastic fixing base;

one surface of the tobacco tar storage piece which is away from the ultrasonic atomization piece is in contact with a tobacco tar guide body fixed in the elastic fixing base; and the tobacco tar guide body communicates with the tobacco tar cavity.

2. The atomizer of electronic cigarette of claim 1, wherein one surface of the ultrasonic atomization piece which is away from the tobacco tar storage piece is in contact with an elastic pressure cover; the elastic pressure cover is fixed in a connecting sleeve; and the connecting sleeve is connected with the elastic fixing base.

3. The atomizer of electronic cigarette of claim 2, wherein a first through hole is provided in the elastic-pressure cover; a mounting base is fixed in the first through hole; a first electric conductor is installed on the mounting base; a second electric conductor is provided between the tobacco tar storage piece and the elastic fixing base; and both of the first electric conductor and the second electric conductor are in contact with the ultrasonic atomization piece.

4. The atomizer of electronic cigarette of claim 3, wherein the second electric conductor comprises a recessed part with an inverted U-shaped cross section, the structures of both sides of the recessed part are symmetrical, a left side cross section of the recessed part comprises a vertical part and a horizontal part connected with the vertical part, and the horizontal part is connected with the left side of the recessed part; the recessed part is provided in a mounting hole in the middle of the elastic fixing base; both sides of the recessed part are provided in grooves on both sides of the mounting hole in the elastic fixing base, and the vertical part of the second electric conductor is provided with a vent hole; the ultrasonic atomization piece and the tobacco tar storage piece are fixed in the second electric conductor; and an edge of the ultrasonic atomization piece is in contact with an inner wall of the vertical part.

5. The atomizer of electronic cigarette of claim 4, wherein the tobacco tar guide body comprises an annular bottom and two projections provided on the annular bottom, and the two projections respectively stretch into two fixing holes in the elastic fixing base on the side of the mounting hole.

6. The atomizer of electronic cigarette of claim 1, wherein the side wall on the top end of the tobacco tar cavity is in fixed connection with an upper fixing sleeve; the side wall on the bottom end of the tobacco tar cavity is in fixed connection with a lower fixing sleeve; tobacco tar block rings are provided between the side wall on the top end of the tobacco tar cavity and the upper fixing sleeve and between the side wall on the bottom end of the tobacco tar cavity and the lower fixing sleeve; the top end of the upper fixing sleeve is in fixed connection with a suction nozzle base; and a suction nozzle is installed on the suction nozzle base.

7. The atomizer of electronic cigarette of claim 6, wherein a bottom end of the lower fixing sleeve is provided in a threaded sleeve with an open upper end; an electrode ring mounting hole is provided in a bottom surface of the threaded sleeve; and an electrode ring stretches into the electrode ring mounting hole and is in insulation connection with the side wall of the electrode ring mounting hole.

8. The atomizer of electronic cigarette of claim 7, wherein the tobacco tar cavity is provided below the tobacco tar guide body.

9. The atomizer of electronic cigarette of claim 8, wherein a supporting tube provided along the axial direction of the tobacco tar cavity is fixed in the tobacco tar cavity; tobacco tar guide cotton is provided outside the supporting tube; and the top end of the tobacco tar guide cotton is in contact with the tobacco tar guide body.

10. The atomizer of electronic cigarette of claim 9, wherein an outer tube is provided outside the tobacco tar guide cotton, and a tobacco tar inlet hole is provided in the outer tube.

11. The atomizer of electronic cigarette of claim 10, wherein a first convex ring and a second convex ring are provided respectively on the outer wall of the top end and on the outer wall of the bottom end of the supporting tube; the tobacco tar storage cotton and the outer tube are provided between the first convex ring and the second convex ring; the top end of the supporting tube stretches into a second through hole in the annular bottom of the tobacco tar guide body, and the lower surface of the first convex ring is in contact with the upper surface of the annular bottom of the tobacco tar guide body; and the second convex ring is provided on a third through hole in the lower fixing sleeve.

12. The atomizer of electronic cigarette of claim 11, wherein the top end of the electrode ring is in contact with the bottom end of an electrode column; and the top end of the electrode column is in contact with the second electric conductor after penetrating through the supporting tube.

13. The atomizer of electronic cigarette of claim 12, wherein the suction nozzle base comprises a connecting base at the bottom, and a cylinder with an open top end is fixed to the end face of the connecting base; the cylinder is in fixed connection with the suction nozzle; a connecting hole is provided in the connecting base in the cylinder; the elastic fixing base and the connecting sleeve are both provided in the connecting base, and the top end of the connecting sleeve is in fixed connection with the inner wall of the connecting hole; a vent ring is provided in the connecting base between the cylinder and the connecting hole; a gap is provided among the connecting sleeve, the elastic fixing base and the inner wall of the connecting base, and the gap communicates with the vent ring.

14. The atomizer of electronic cigarette of claim 12, wherein a gap is provided between the electrode column and the inner wall of the supporting tube; a first air inlet hole communicated with the gap is provided in the threaded sleeve; both of the interior of the top end and the interior of the bottom end of the electrode column are hollow cavities, and second air inlet holes communicated with the gap are provided in the side walls of the hollow cavities;

both of the top end and the bottom end of the electrode column are open, and a third air inlet hole is provided in the bottom end of the electrode column; and the first air inlet hole, the third air inlet hole, the hollow cavity in the interior of the bottom end of the electrode column, the second air inlet hole in the hollow cavity of the bottom end of the electrode column, the gap, the second air inlet hole in the hollow cavity of the top end of the electrode column, the hollow cavity in the interior of the top end of the electrode column, the vent hole, the vent ring and the inner cavity of the suction nozzle form the airflow passage.

15. The atomizer of electronic cigarette of claim 8, wherein the elastic fixing base is provided in the upper fixing sleeve, and the annular bottom of the tobacco tar guide body is in contact with the end face of the upper fixing sleeve; a tobacco tar pass hole is provided in the end face of the upper fixing sleeve; and the annular bottom of the tobacco tar guide body communicates with the tobacco tar cavity through the tobacco tar pass hole.

16. The atomizer of electronic cigarette of claim 7, wherein the tobacco tar cavity is provided above the ultrasonic atomization piece.

17. The atomizer of electronic cigarette of claim 16, wherein the recessed part of the second electric conductor is in contact with the electrode ring, and a hole is provided in the recessed part; an air passage penetrating through the electrode ring is provided in the electrode ring; and the air passage communicates with the hole.

18. The atomizer of electronic cigarette of claim 17, wherein the atomizer of electronic cigarette further comprises an atomization head connecting base and an atomization head upper cover; the upper end of the atomization head connecting base is in fixed connection with the atomization head upper cover; the elastic fixing base and the connecting sleeve are both fixed in a hollow cavity formed by the atomization head connecting base and the atomization head upper cover; the upper end of the atomization head upper cover is fixed in the lower fixing sleeve; passages are provided between the atomization head upper cover and the lower fixing sleeve and between the atomization head connecting base and the threaded sleeve, and the passages communicate with the tobacco tar cavity through tobacco tar outlet holes in the lower fixing sleeve.

19. The atomizer of electronic cigarette of claim 18, wherein the tobacco tar guide body is in contact with the inner wall of the lower end of the atomization head connecting base, and a tobacco tar inlet communicated with the passages is provided in the side wall of the lower end of the atomization head connecting base.

20. The atomizer of electronic cigarette of claim 19, wherein an air tube is fixed in the tobacco tar cavity; a notch is provided in the upper end of the atomization head connecting base; a vent passage is provided between the connecting sleeve and the atomization head upper cover, and the notch communicates with the vent passage; a vent hole is provided in the upper end face of the atomization head upper cover; and the air passage, the hole, the gap between the horizontal part of the second electric conductor and the ultrasonic atomization piece, the notch, the vent passage, the vent hole, the inner cavity of the air tube and the inner cavity of the suction nozzle form the airflow passage.

21. The atomizer of electronic cigarette of claim 20, wherein an air regulating hole communicated with the airflow passage is provided in the suction nozzle base.

22. The atomizer of electronic cigarette of claim 21, wherein a regulating device for regulating the amount of the airflow of the air regulating hole is provided on the suction nozzle base outside the air regulating hole.

23. The atomizer of electronic cigarette of claim 6, wherein an air pass hole or an air pass groove is provided in the tobacco tar storage piece.

* * * * *